US005239588A

United States Patent [19]

Davis

[11] Patent Number: 5,239,588

[45] Date of Patent: Aug. 24, 1993

[54] HEARING AID

[76] Inventor: Murray A. Davis, 4874 Cote des Neiges Road, Apt. 1001, Montreal, Quebec, H3V 1H4, Canada

[21] Appl. No.: 451,785

[22] Filed: Dec. 18, 1989

[30] Foreign Application Priority Data

Dec. 21, 1988 [CA] Canada ..... 586680

[51] Int. Cl.[5] ..... H04R 25/00

[52] U.S. Cl. ..... 381/68; 381/68.1; 600/25

[58] Field of Search ..... 381/68, 23.1, 68.1, 381/72, 69, 26, 25; 600/25; 128/420.5, 420.6; 623/10

[56] References Cited

U.S. PATENT DOCUMENTS

| | | | |
|---|---|---|---|
| 2,584,896 | 2/1952 | Maffris | 381/69 |
| 2,678,973 | 5/1954 | Newman | 381/151 |
| 3,098,121 | 7/1963 | Wadsworth | 381/72 |
| 3,557,775 | 1/1971 | Mahoney | 128/420.6 |
| 3,835,263 | 9/1974 | Killion | 381/68.1 |
| 3,844,271 | 10/1974 | Lake | 381/69 |
| 3,870,832 | 3/1975 | Fredrickson | 381/68.3 |
| 3,876,843 | 4/1975 | Moen | 381/68.1 |
| 3,928,734 | 12/1975 | Noury, Jr. | 381/169 |
| 4,466,117 | 8/1984 | Görike | 381/26 |
| 4,612,915 | 9/1986 | Hough et al. | 381/68.3 |
| 4,633,498 | 12/1986 | Warnke et al. | 381/26 |
| 4,771,454 | 9/1988 | Wilcox, Jr. | 381/72 |
| 4,932,405 | 6/1990 | Peeters et al. | 128/420.6 |

FOREIGN PATENT DOCUMENTS

| | | | |
|---|---|---|---|
| 1591095 | 12/1970 | Fed. Rep. of Germany | 381/25 |
| 0153698 | 8/1985 | Japan | 381/23.1 |

*Primary Examiner*—James L. Dwyer
*Assistant Examiner*—Jason Chan
*Attorney, Agent, or Firm*—Pascal & Associates

[57] ABSTRACT

A hearing aid having a stereophonic microphone mounted on a flexible base and an adhesive for adhering it to the top of the head. This substantially eliminates the shadow effect encountered when two separate hearing aids are used, one for each ear, which reduces the ability of the wearer to locate the source of sounds originating at an angle from a vertical central plane passing through the nose and axis of the wearer.

7 Claims, 1 Drawing Sheet

HEARING AID

FIELD OF THE INVENTION

Figure 1:
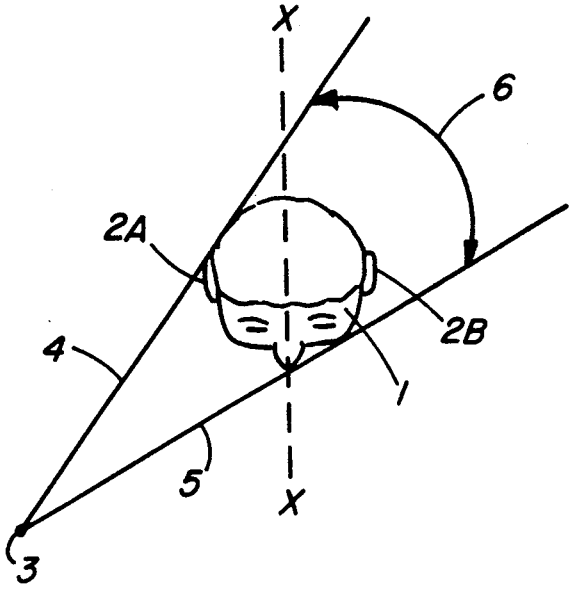

This invention relates to a hearing aid and in particular to a binaural hearing aid.

BACKGROUND OF THE INVENTION

Persons with hearing impairment are often fitted with hearing aids. In such cases the degree of hearing loss often is greater in one ear than the other. Usually the audiologist considers that the most important remedy is to provide a hearing aid on the assumption that this will solve the problem of the hearing impaired person, and not a great deal of regard is taken of the psychological aspects of hearing remedy. A hearing aid for one ear is usually prescribed.

In the use of a hearing aid for one ear, usually the volume is turned up by the user to a comfortable hearing level. Even if there is some level of hearing in the other ear, it has been found that the ability to locate the source of sound is lost. Furthermore, background noises interfere substantially with the understanding of speech where there is a significant background noise level, such as at a party. Often the person wearing the hearing aid finds it difficult to distinguish between the words spoken by a person directly to him, and the words spoken by a loud talker some distance away or behind him.

Particularly for people who have lost hearing in both ears and who wish to locate the source of sounds, sometimes two hearing aids are prescribed, one for each ear. It has been found that while this can increase the intelligibility of voices or other sounds being heard, it does not readily solve the problem of poor sound location, except in some exceptional circumstances, such as when a talker is directly in front of the hearing impaired listener.

While the problem of peripheral sounds masking the sound that the hearing impaired listener wishes to hear remains, and can even be compounded when two hearing aids are used, the lack of ability to locate the source of the sound is caused by what is known as the shadow effect. In the case in which the talker is to the side of the listener who has a pair of hearing aids, the head forms an acoustic shadow over the hearing aid microphone which is farthest from the talker. This results in an incorrect, significantly lower level of sound in the ear which is furthest from the talker, making the person wearing the hearing aid think that the source of sound is further to the side than it actually is. The shadow effect is very significant and for most unexpected sounds makes quick location of the source of the sounds virtually impossible. This can be embarrassing under some circumstances, and dangerous in others, for example where the dual hearing aid wearer crosses the street and attracts a warning horn from an uncoming vehicle to one side of the wearer.

In addition, while there have been continual advances in miniaturization of hearing aids, most hearing aids are still noticeable to others. In old fashioned hearing aids the wearer had a belt pack for carrying a microphone, amplifier and batteries, and a wire led inside the wearer's clothing, up the neck, to an earphone. More recent hearing aids have been built into the temples of eyeglasses (as in U.S. Pat. No. 3,665,121 issued May 23, 1971 to Beltone Electronics Corporation), or are fitted around the top of the ear with the microphone, amplifier and transducer in a case behind the ear and an acoustic tube leading to an earplug over the ear and into the ear, etc. To some wearers, the observeable presence of the hearing aid is embarrassing.

SUMMARY OF THE INVENTION

The present invention substantially solves in one embodiment two of the above noted problems, and in another embodiment, all three of the problems. With use of the present invention the source of sounds can be readily located, with substantially no shadow effect, and peripheral sounds are substantially reduced relative to the sounds which the wearer wishes to listen to. According to another embodiment, the entire hearing aid is virtually invisible.

In accordance with a preferred form of the invention, a stereophonic microphone having a pair of channels is disposed at a central location at the top of the head. A pair of miniature (microchip) amplifiers is used, with conductive means for each of the channels connecting the microphone to the inputs of the respective amplifiers. Electroacoustic transducers located at the ears connect to the outputs of the amplifiers with wires hidden in the hair.

Since a stereophonic microphone is used, each channel having directionality, the location of the sound can be readily determined. Because the stereophonic microphone is located at the top of the head of the user, no shadow effect results. Also because of the use of a stereophonic microphone, with it inherent directionality, extraneous sounds arising behind the microphone are substantially reduced in amplitude relative to those arising in the front or to the sides within the main sensitivity lobes of the microphone. The result is improved intelligibility even in the presence of peripheral intruding noises behind the user, and ready location of the source of the sounds.

According to another embodiment, the stereophonic microphone is covered with bioinert material and is located under the scalp of the wearer. A stereophonic audio amplifier formed of a monolithic semiconductor chip is connected to the microphone immediately adjacent thereto, and also under the scalp. Wires connected to the output ports of the amplifier pass around the respective opposite sides of the wearer's head under the scalp and are connected to electroacoustic transducers at the opposite ears of the wearer. The wires should be covered with bioinert material so that they can be located beneath the scalp and skin of the wearer, leading to a region behind each ear.

If a bone conduction transducer is used, it can be drilled into the skull bone behind each ear, under the skin, and the wires connected thereto as described in U.S. Pat. No. 4,612,915 issued Sep. 23, 1986 to Xomed, Inc. It should be made of or covered by bioinert material, as should the wires.

In the case in which electromagnetic or crystal electroacoustic transducers are used, the wires can emerge from under the hair or the skin immediately behind each ear and pass through a hole in each ear and are connected to the electroacoustic transducers. The location of the hole in each ear can made substantially inwardly of the outer part of ear so that the location of the emergence of the wire is difficult to see. With the use of a miniature earplug (earphone) as the electroacoustic transducter, the entire hearing aid is rendered virtually invisible.

The stereophonic microphone can be glued to a shaved spot at the top of the head, with a modern surgical glue such as one based on methylcryanate. The wires can be led under the hair but over the scalp to locations behind each ear, and pass either through a hole in the ear or around the top of the ear to the electroacoustic transducers. In such cases it is preferred that the stereophonic microphone should be covered with a rubber membrane to protect it from water or other contaminents, and should be fixed to a flexible base which is glued to the top of the head, while conforming to its shape.

BRIEF INTRODUCTION TO THE DRAWINGS

Figure 2:
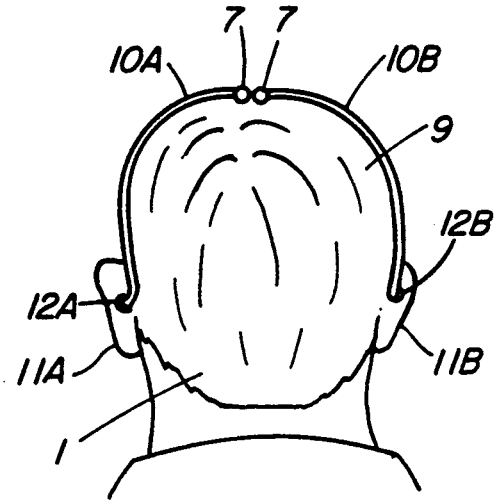
Figure 3:
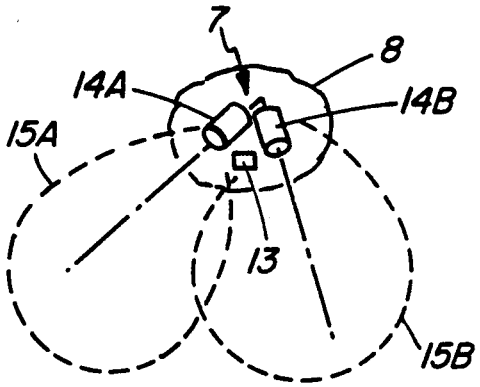
Figure 4:
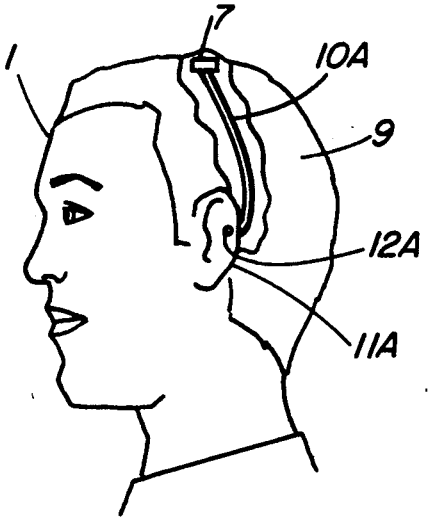
Figure 5:
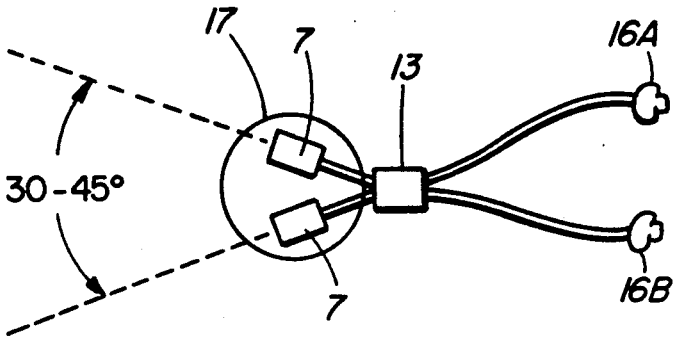

A better understanding of the invention will be obtained by reference to the detailed description below, with reference to the following drawings, in which;

FIG. 1 is top view of a dual hearing aid wearer illustrating the shadow effect, FIG. 2 is a rear view of the wearer of a hearing according to the present invention, FIG. 3 is a enlarged view of a stereophonic microphone, FIG. 4 is a side view of a wearer of the present invention, and FIG. 5 is a block diagram of the present invention.

DESCRIPTION OF THE INVENTION

Turning to FIG. 1, a hearing impaired person 1 is shown wearing a pair of hearing aids 2A and 2B. A source of sound 3 is desired to be heard and understood by the person 1. While a person having normal hearing and not having hearing aids can determine the location of the source of sound by both amplitude and phase descrimination, it has been found that the wearer of a pair of hearing aids even equalizing the sound level to both ears is unable to do so when the source of sound is off to one side, because of an apparent acoustic shadow effect. This occurs due to the shadowing by the person's head of one of the hearing aid microphones, the one which is furthest from the source of sound.

The problem will be understood by drawn lines 4 and 5 from the source of sound 3 tangent to both sides of the head of the person 1. While the presence of the shadow effect is not formed so precisely, the boundaries approximate lines 4 and 5. The "shadow" occurs behind the person 1 within the angle shown by arrow 6. Hearing aid 2A is not in the acoustic shadow, while hearing aid 2B is in the shadow in the illustration. If the wearer turns his head counterclockwise, hearing aid 2B goes deeper into shadow, and this makes the problem worse. If he turns his head clockwise so that both hearing aids 2A and 2B are out of the shadow, he can then determine the source of sound by at least amplitude descrimination. Clearly the location of the shadow is determined both by the distance of the source from the person 1, and its angle off the central vertical plane X—X passing through the nose of the person 1. For this reason as well, when the more distant ear is in shadow, the location of the sound is very difficult to find. The shadow effect is described in U.S. Pat. No. 3,665,121, issued May 23, 1972, to Beltone Electronics Corporation, in column 1, lines 7–43.

In accordance with the present invention, a forward facing miniature stereophonic microphone 7 is used and with means to adhere it to the top of the head of the person 1, as shown in FIG. 2. It will be apparent that there will virtually no shadowing effect from any source of sound located 360° degrees around the head. The only practical shadowing that can occur for this structure is if the source of sound is within centimeters of the front of the face of the user below his chin, and in that case both channels of the stereophonic microphone will be shadowed at the same time.

In accordance with another embodiment, the microphone can be encapsulated in bioinert material 8, as shown in FIG. 3. The bioinert material can be resilient silicone, such as is often used in breast implants. The miniature stereophonic microphone can be surgically implanted below the surface of the scalp as shown in FIG. 4, the scalp 9 being cut away in FIG. 4 to show implantation of the microphone 7. The wires, also covered with bionert material, should be conducted under the scalp to locations behind the ears 11A and 11B.

In the preferred embodiment, in which the microphone is located at the top of the head over the scalp as shown in FIG. 2, it should be comprised of a bottom base plate, for retaining the microphone, preferably flexible, which can be fastened to the top centre of the scalp by a surgical cement such as one based on methylcryanate. The flexible plate can be flexible plastic or rubber, that can conform to the shape of the top of the head. Wires 10A and 10B are connected to the two channels of the microphone respectively, and pass over the scalp under the hair, as shown in FIG. 2.

The wires can be passed through holes **12*a* and 12*b*** punched in the ears of the user. Alternatively the wires can pass over the ears and be connected to either amplifiers or electroacoustic transducer earphones worn by the person.

It should be noted that the stereophonic amplifier can be located either at the earphones or at the microphone 7. It is preferred however that it should be located at microphone 7, and that amplifier should be a microchip audio amplifier, that is, a monolithic semiconductor integrated circuit. A removeable hearing aid battery should also be located in the same housing as the amplifier.

In the case of the implantation embodiment as in FIG. 4, it is preferred that the micro-chip should be located within the bionert material with the stereophonic microphone 7. This structure is shown in FIG. 3, with micro-chip audio amplifier 13 disposed immediately next to the microphone 7, and encapsulated in bioinert material 8. The wires can pass under the skin behind the ear, and through a hole punched in the ear near the entrance to the ear canal and be connected outside the skin to an electroacoustic transducer such as a crystal or electromagnetic miniature earplug. Alternatively a bone conduction electroacoustic transducer can be used immediately behind the ear and under the skin. In this case there will be no observed hearing aid at all, since it will be completely hidden under the scalp and the skin of the user.

The apparatus can be powered by a storage battery, charged by A.C. electromagnetic signals passed through the skin, and rectified to provide D.C. power, and stored in the miniature storage (e.g. Ni Cad) battery, all protected by bioinert material, retained under the skin, in a structure similar to that described in U.S. Pat. No. 3,870,832 issued Mar. 11, 1975 by John M. Fredrickson. The signal electromagnetic signal generation can be powered by a hearing aid battery and oscillator in a case brought adjacent the pick up coil, outside the skin.

In FIG. 3 the stereophonic microphone is shown. It can be formed of a pair of miniature electret microphones 14*a* and 14*b*, each having a cardioid sensitivity response, as shown by the dashed lines 15*a* and 15*b*. Each electret microphone is preferably no greater than ¼" diameter. Preferably the maximum sensitivity axes of the microphones are separated by between about 30 and 45 degrees, but the degree of separation will depend on the cardioid response of the microphones. Where the sensitivities are high and the response pattern narrow, the separation can be smaller, and vice versa. Another stereophonic microphone can be made by fixing the transducers described in U.S. Pat. No. 3,876,843 issued Apr. 8, 1975 to Textron Inc. together on a supporting plate, with their maximum sensitivity axes separated by between about 30 and 45 degrees.

FIG. 5 illustrates a block diagram of the invention. The stereophonic microphone 7 is connected to a monolithic integrated circuit audio amplifier 13 which has its channels connected to corresponding electroacoustic transducers 16A and 16B. Both are fastened to flexible plate 17. It is important that the microphone should be stereophonic, because this provides the directionality, which both allows the user to locate the source of sound and substantially increases the signal to noise ratio of a sound source to which attention is to made to the front or sides of the person, relative to sounds comming from the rear. Thus the masking "party effect" by extraneous sounds is substantially reduced. It is also a key aspect of the present invention that the stereophonic microphone should be formed so as to be located at the top of the head of the person wearing the hearing aid. This eliminates the shadow effect, and allows the stereophonic microphone to be effective as a hearing aid microphone.

A person understanding this invention may now conceive of variations or alternative structures using the principles described herein. All are considered to be within the sphere and scope of the invention as defined in the claims appended hereto.

I claim:

1. A hearing aid comprising a miniature stereophonic microphone having a pair of channels, means for retaining the microphone at a central location at the top of the head, a stereophonic integrated circuit connected to the output of the microphone comprising stereophonic amplifiers, and further including electroacoustic transducers for disposition at each of the ears of the user connected to the outputs of the amplifiers, conductive means connecting an output of each amplifier to a corresponding electroacoustic transducer, and the stereophonic microphone being covered with bioinert material for retention below the scalp of the user.

2. A hearing aid as defined in claim 1, in which the electroacoustic transducers are formed as bone conduction transducers, screwed into the bone of the skull immediately behind the ears and under the skin of the user, and being of material which is at least covered with bioinert material.

3. A hearing aid as defined in claim 1, in which the conductive means are comprised of wires covered with bioinert material for retention below the scalp and skin, having length sufficient to extend from the centre top of the head of a person to the ear.

4. A hearing aid as defined in claim 2 or 3, in which the electroacoustic transducers are formed as miniature speaker earphones, the wires emerging therefrom through the ear of the user to the back thereof and disposed up the sides of the head of the user to the amplifiers.

5. A hearing aid as defined in claim 3, in which the electroacoustic transducers are formed as miniature speaker earphones, the wires emerging therefrom over the ear of the user to the back thereof and disposed up the sides of the head of the user to the amplifier.

6. A hearing aid as defined in claim 1, in which the stereophonic microphone is formed of a pair of cardioid microphone elements fastened together and having their maximum sensitivity axes between about 15 and 22 degrees on each side of a vertical plane passing through the nose and is orthogonal to a line passing through the ears of the user.

7. A hearing aid as defined in claim 1, in which the stereophonic microphone is formed of a pair of electret microphone elements fastened together and having their maximum sensitivity axes between about 15 and 22 degrees on each side of a vertical plane passing through the nose and is orthogonal to a line passing through the ears of the user.

* * * * *